US008727124B2

(12) United States Patent
Franciskovich et al.

(10) Patent No.: US 8,727,124 B2
(45) Date of Patent: May 20, 2014

(54) TRAUMA RESISTANT SUSPENSION CELL PACKAGE FOR SECURE SHIPPING AND STORAGE

(75) Inventors: Phillip P. Franciskovich, Concord, OH (US); Tricia A. Cregger, Fairlawn, OH (US)

(73) Assignee: American Sterilizer Company, Mentor, OH (US)

( * ) Notice: Subject to any disclaimer, the term of this patent is extended or adjusted under 35 U.S.C. 154(b) by 103 days.

(21) Appl. No.: 13/367,404

(22) Filed: Feb. 7, 2012

(65) Prior Publication Data

US 2013/0199955 A1 Aug. 8, 2013

(51) Int. Cl.
*B65B 63/08* (2006.01)

(52) U.S. Cl.
USPC ..... 206/593; 206/370; 206/443; 206/446; 206/569; 206/591

(58) Field of Classification Search
CPC ..... B65D 5/48038; B65D 5/4804; B65D 5/48026; B65D 5/48; B65D 85/30; B65D 85/00
USPC ..... 206/459.1, 583, 370, 363, 364, 443, 206/446, 563, 569, 591, 593, 594; 435/31, 435/287.4, 4; 220/529, 552
See application file for complete search history.

(56) References Cited

U.S. PATENT DOCUMENTS

| | | | | |
|---|---|---|---|---|
| 3,142,385 A | | 7/1964 | Kahlenberg | |
| 3,446,342 A | | 5/1969 | Michel | |
| 3,621,994 A | | 11/1971 | Brown | |
| 3,647,105 A | | 3/1972 | Keeslar | |
| 3,682,597 A | * | 8/1972 | Husch | 206/446 |
| 3,882,315 A | | 5/1975 | Soldan | |
| 4,187,975 A | | 2/1980 | Shepherd | |
| 4,434,890 A | * | 3/1984 | Sieck et al. | 206/443 |
| 4,501,360 A | | 2/1985 | Levy et al. | |

(Continued)

FOREIGN PATENT DOCUMENTS

| | | |
|---|---|---|
| DE | 3725018 | 2/1989 |
| DE | 9406110 U1 | 8/1994 |
| DE | 202007011660 U1 | 11/2007 |
| WO | 02/087980 | 11/2002 |

OTHER PUBLICATIONS

PCT/US2013/023377; PCT International Search Report and Written Opinion of the International Searching Authority dated May 6, 2013.

*Primary Examiner* — Andrew Perreault
(74) *Attorney, Agent, or Firm* — Renner, Otto, Boisselle & Sklar, LLP

(57) ABSTRACT

An impact and crush resistant shipping container for a vial and cap assembly, e.g., a FABI, the container having sides and a bottom defining a cavity and an opening, and a closeable cover; a partitioning divider defining at least one vertical receptacle for receiving a portion of the vial and cap assembly; an insert having at least one opening therethrough for receiving the vial and cap assembly, each opening sized such that the vial and cap assembly can be suspended in the opening, and the partitioning divider is positionable with respect to the insert such that the vial and cap assembly can be suspended at least partially within the receptacle, and the partitioning divider and the insert with the at least one vial and cap assembly suspended therein are positionable within the cavity such that the cover can be closed without contacting the at least one vial and cap assembly.

17 Claims, 6 Drawing Sheets

(56) References Cited

U.S. PATENT DOCUMENTS

| | | | | | |
|---|---|---|---|---|---|
| 4,853,266 | A | | 8/1989 | Cullen | |
| 4,932,533 | A | | 6/1990 | Collier | |
| 5,029,699 | A | | 7/1991 | Insley et al. | |
| 5,057,282 | A | * | 10/1991 | Linder | 206/370 |
| 5,160,021 | A | | 11/1992 | Sibley et al. | |
| 5,291,997 | A | | 3/1994 | He et al. | |
| 5,314,060 | A | * | 5/1994 | Cain | 206/563 |
| 5,330,056 | A | | 7/1994 | de la Rocha | |
| 5,579,929 | A | | 12/1996 | Schwartz | |
| 5,833,057 | A | | 11/1998 | Char et al. | |
| 6,267,256 | B1 | | 7/2001 | Thilly | |
| 6,361,746 | B1 | | 3/2002 | Wlodarski | |
| 6,472,675 | B2 | | 10/2002 | White et al. | |
| 6,569,676 | B1 | | 5/2003 | Tripp et al. | |
| 6,662,941 | B2 | | 12/2003 | Lowry et al. | |
| 6,719,141 | B2 | | 4/2004 | Heinz et al. | |
| 7,152,736 | B1 | | 12/2006 | Menichini | |
| 7,624,873 | B2 | | 12/2009 | Tennant et al. | |
| 2001/0052476 | A1 | | 12/2001 | Heinz et al. | |
| 2005/0126953 | A1 | | 6/2005 | Lantz | |
| 2010/0081165 | A1 | | 4/2010 | Pasmore et al. | |

* cited by examiner

TRAUMA RESISTANT SUSPENSION CELL PACKAGE FOR SECURE SHIPPING AND STORAGE

FIELD OF THE INVENTION

The present invention relates to packaging for shipping and storage of small containers, and more particularly to packaging for shipping and storage of biological indicator vial and cap assemblies that are ready to use.

BACKGROUND

Current forms of secondary packaging typically used for shipping, storage and presentation of biological indicators are comprised of cardboard, plastic or film-based materials. They usually incorporate some means to both contain, and to varying degrees, protect their contents from the external forces that might be encountered in normal shipping and handling. A driving design limitation is cost. In some cases, where the internal product being protected is exceptionally frangible, additional strengthening of the package may be provided. Conventionally, biological indicators with a frangible component have been stored and shipped in boxes with internal grids providing each individual biological indicator with a separate cell for its containment. However, for a new generation of biological indicators that are activated by pressing or screwing a cap down onto a vial, the convention designs are inadequate to provide low cost, secure packaging. The new generation of biological indicators are referred to as "fast-acting biological indicators" or "FABI". Therefore, a need arises for improved packaging specifically designed for the FABI system of biological indicators.

SUMMARY

The present invention provides a new shipping container for biological indicators which addresses the problems of the prior art packaging.

In one embodiment, the present invention provides an impact and crush resistant shipping container for use with at least one vial and cap assembly, the at least one vial and cap assembly having an assembly height, a first width and an indentation having a second width less than the first width, the indentation located intermediate the assembly height, the container including:

an outer body having sides and a bottom defining a cavity and an opening, the cavity having a depth, the body further including a closeable cover for enclosing the cavity;

a partitioning divider, sometimes referred to herein as a grid, defining at least one vertically extending receptacle for receiving at least a portion of the at least one vial and cap assembly, the receptacle having a depth greater than the assembly height, the partitioning divider having a height less than the depth of the cavity;

an insert having at least one opening therethrough for receiving the at least one vial and cap assembly, each opening having a width or size greater than the second width and less than the first width of the at least one vial and cap assembly such that the at least one vial and cap assembly can be suspended in the opening of the insert at the indentation, wherein the partitioning divider is positionable in relation to the insert such that the at least one vial and cap assembly can be suspended at least partially within the receptacle, wherein the partitioning divider and the insert with the at least one vial and cap assembly suspended therein are positionable within the cavity such that, with the partitioning divider and the insert with the at least one vial and cap assembly positioned within the cavity, the cover can be closed without contacting the at least one vial and cap assembly.

In one embodiment, the opening in the insert further comprises a frangible or deformable portion, wherein if a sufficient force is applied to the vial and cap assembly, the vial and cap assembly can be pushed through the opening and pass or fall into the receptacle by breaking or deforming the frangible or deformable portion.

In one embodiment, the receptacle depth is sufficient to avoid contact between the broken or deformed portion when the vial and cap assembly has passed or fallen into the receptacle.

In one embodiment, the insert comprises a substantially flat panel with the openings therethrough. In one embodiment, the insert further comprises a plurality of vertically extending outer sidewalls dimensioned to fit outside an outer periphery of the partitioning divider within the cavity. In one embodiment, the insert further comprises a pair of vertically extending sidewalls attached on opposite sides of the insert and a lower panel attached to the sidewalls, such that the insert forms a sleeve dimensioned to receive the partitioning divider within the sleeve.

In one embodiment, the container further comprises an absorbent pad within the outer body. In one embodiment, the absorbent pad is disposed in the cavity and the partitioning divider is positioned over the pad. In one embodiment, the absorbent pad is disposed in a bottom portion of the cavity. In one embodiment, the absorbent pad further includes an antimicrobial material.

In one embodiment, the container further comprises a reinforcing divider disposed within the cavity on an opposite side of the insert from the partitioning divider and extending toward the cover. In one embodiment, elements of the reinforcing divider are substantially aligned with and correspond to elements of the partitioning divider.

In one embodiment, the cover further comprises side and front flaps insertable into the cavity when the cover closes.

In one embodiment, the container further comprises at least one vial and cap assembly suspended in the at least one opening.

In one embodiment, the vial and cap assembly contains a sterilization indicator. In one embodiment, the sterilization indicator comprises a self-contained biological indicator. In one embodiment, the sterilization indicator comprises a fast-acting biological indicator.

In one embodiment, the vial and cap assembly comprises an un-activated position and an activated position, and the vial and cap assembly is activated by an action including a reduction of its height.

In one embodiment, placement of the vial and cap assembly in the insert into the cavity prevents premature and/or accidental activation of the vial and cap assembly during shipment and handling of the container.

In one embodiment, the outer body comprises reinforced cardboard or plastic, double layer cardboard or plastic, corrugated cardboard or plastic, or a combination of any two or more thereof.

Figures 1A, 1B:
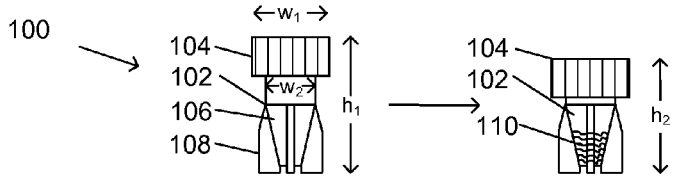
FIGS. 1(*a*) and 1(*b*) are schematic side elevational views of an embodiment of a vial and cap assembly (FABI) with which the present invention is useful, in both a pre-activated (1(*a*)) and activated (1(*b*)) configurations.

It should be appreciated that for simplicity and clarity of illustration, elements shown in the Figures have not necessarily been drawn to scale. For example, the dimensions of some of the elements may be exaggerated relative to each other for clarity. Further, where appropriate, reference numerals have been repeated among the Figures to indicate corresponding elements.

Furthermore, it should be appreciated that the present invention can be practiced in conjunction with fabrication techniques and FABIs known in the art, and only so much of the components are included as are necessary for an understanding of the present invention.

DETAILED DESCRIPTION

As noted, the protection provided by prior art designs is inadequate in the case of the FABI system to which the present invention is applicable. The FABI system comprises a unique design compared to all other indicators that have preceded it. The FABI system features a screw down (or pop down) cap that both contains the liquid recovery medium and delivers this medium to the bottom vial upon activation. Intentional activation is achieved by the gentle closing of the lid by rotation (screwing down from the unscrewed starting position), or by pressing the cap down onto the vial with sufficient force to break the seal and activate the FABI.

It has been discovered that the same design feature that provides for the easy activation of the FABI by end users also provides a means for the unintended activation of the vial by a level of physical trauma that might be reasonably expected in normal shipping and handling. Even while contained in the traditional packaging available today the vials may become prematurely activated by vibrations, dropping or other shocks that cause the cap to move down upon the vial thus puncturing the protective film seal enclosing the liquid component in the cap and thereby activating the FABI. A new package design that takes into account the particular frangible nature of the FABI system and the sort of trauma that may result in its inadvertent activation has been needed, and is provided by the present invention.

Thus, in accordance with the present invention, a new package is provided that accommodates the unique nature of the FABI indicator while simultaneously providing all the other requirements for cost-effective shipping and storage. Of course, it will be understood that the present invention can be used with other biological indicators and other devices that need protection similar to that provided by the present invention, provided that the subject device includes a suitably placed recess or indentation by which the device can be suspended as described herein.

The present invention is particularly useful for transport and storage of a FABI, an example of which is shown in FIG. 1. FIGS. 1(*a*) and 1(*b*) are schematic side elevational views of an embodiment of a FABI 100 for which the present invention is useful. As shown in FIG. 1(*a*), the FABI 100 includes a vial 102 and a cap 104, forming a vial and cap assembly. The vial 102 may include, for example, an interior chamber 106 and exterior supporting "wings" or legs 108. When the FABI is in its assembled for use, but un-activated, condition, the cap 104 contains a quantity of a liquid medium in a reservoir (not shown), and the vial 107 contains a quantity of a material which, when mixed with the liquid medium from the cap, forms a system for incubation of a biological indicator. Suitable biological indicators are disclosed, for example, in U.S. Patent Appl. Publication No. 2010/0081165, which is commonly owned with the present invention. US 2010/0081165 may be consulted for additional details on a FABI such as that described here and for use with the present invention, and is hereby incorporated by reference herein.

As shown in FIG. 1(*b*), the FABI is activated by lowering the cap 104 onto the vial 102, which action breaks or ruptures the reservoir in which the quantity of liquid was retained, introducing the liquid 110 into the vial. Thus, as shown in FIG. 1(*a*), the vial and cap assembly have an assembly height, $h_1$, a first width $w_1$ and an indentation having a second width, $w_2$, in which $w_2$ is less than $w_1$. In the illustrated embodiment, the indentation is located intermediate the assembly height $h_1$. As shown in FIG. 1(*b*), the cap 104 is lowered onto the vial 102 by, e.g., screwing, pressing or pushing downward on the cap 104 to break a seal, divider or barrier on the vial 102, or by screwing the cap 104 on threads formed on the outside of the vial 102. When the FABI 100 is activated by pressing or screwing the cap 104 downward onto the vial 102, the assembly has a second, reduced height, $h_2$ which is reduced relative to the first height, $h_1$, as shown in FIG. 1(*b*).

Figures 2A, 2B, 2C:
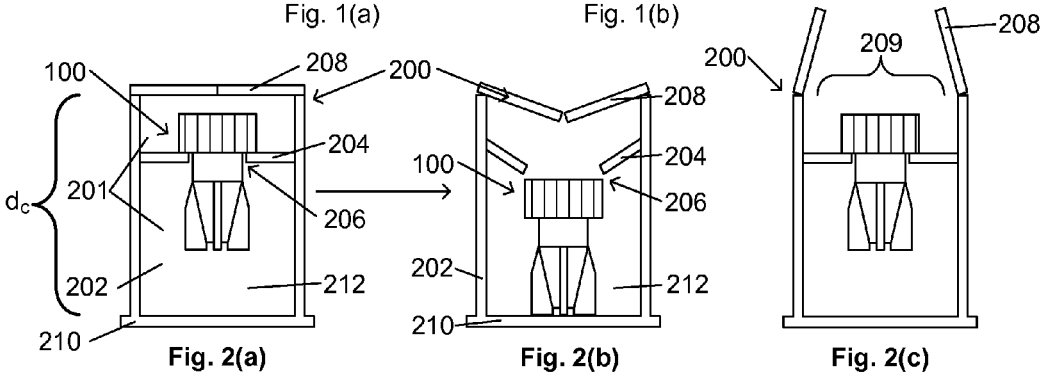
FIGS. 2(*a*), 2(*b*) and 2(*c*) are schematic side elevational and sectional views of a FABI in a container in accordance with an embodiment of the present invention, in each of suspended (2(*a*)), post-trauma (2(*b*)) and open (2(*c*)) positions.

FIGS. 2(*a*), 2(*b*) and 2(*c*) are schematic side elevational and sectional views of a container 200 in which a FABI 100 is held in accordance with an embodiment of the present invention. In FIG. 2(*a*), the FABI 100 is suspended in a cavity 201 having a depth $d_c$ in the position in which the FABI 100 is normally placed for shipment or storage. In FIG. 2(*b*), the container 200 is shown in an exemplary "posttrauma" position. In FIG. 2(*c*), the container 200 is shown with the flaps 208 in an open position, forming and defining an opening 209 in the outer body of the container 200.

In FIGS. 2(*a*) and 2(*b*), the container 200 includes sidewalls 202, an insert 204 having an opening 206 therethrough, a cover 208 and a bottom 210. It is noted that, although the bottom 210 is shown as attached to or integral with the sidewalls 202, this is not necessarily the case, and in many embodiments, while the sidewalls 202 may be in contact with a bottom, there is not necessarily any bond between or other integral connection between them.

As shown in FIG. 2(*a*), the vial and cap assembly of the FABI 100 is suspended by the insert 204, with the opening 206 having a size greater than the width $w_2$ of the indentation forming the neck of the vial, with the cap 104 resting on the insert 204, and with the opening 206 having a size less than the first width $w_1$, such that the FABI 100 can be suspended at least partially within the receptacle 212 with the lower rim of the cap 104 resting on the insert 204 adjacent the opening 206. The FABI 100 remains suspended in this position during normal shipping, handling and storage. As shown in FIG. 2(*a*), with the sidewalls 202 and the insert 204 positioned with the vial and cap assembly, the cover 208 can be closed without contacting the vial and cap assembly 100. The sidewalls 202, the bottom 210, and the cover 208 together form a receptacle 212.

As shown in FIG. 2(*b*), the FABI 100 which was suspended in FIG. 2(*a*) has been pushed through the frangible insert 204 by an impact or other trauma applied to the cover 208. The impact or trauma applied to the cover 208 caused the cover to contact the cap 104 and push downward on the vial and cap assembly (FABI) 100, causing the frangible portion of the insert 204 to give way, break, deform or otherwise open sufficiently, to allow the vial and cap assembly 100 to fall through, into the receptacle 212, in accordance with the present invention. As shown schematically in FIG. 2(*b*), the vial and cap assembly 100 is still protected, has not been activated, and can remain in the receptacle 212. Due to the design of the present invention, even though the outer container was struck by some force sufficient to significantly damage the container and to cause the vial and cap assembly 100 to be pushed through the frangible insert 204, by enlarging the opening 206, the vial and cap assembly were not impacted so as to cause accidental or unintended premature activation of the FABI. Thus, despite the damage to the container, the FABI remains intact and un-activated.

Figure 3A:
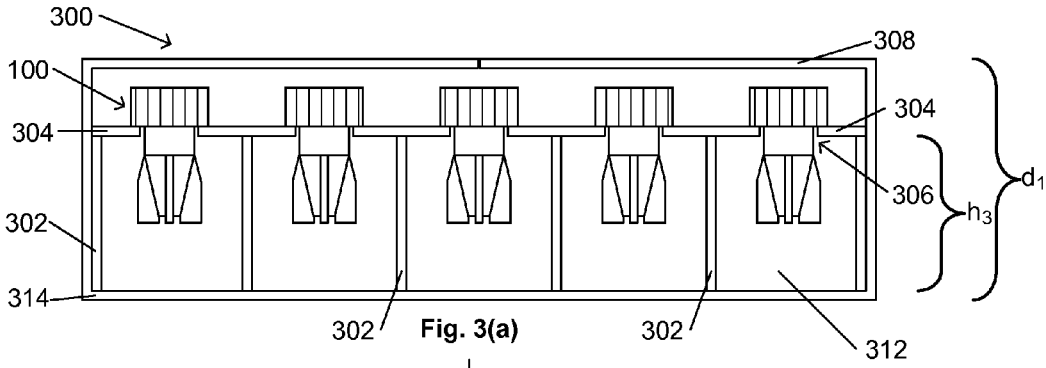
FIGS. 3(*a*) and 3(*b*) are schematic side elevational and sectional views of a row of FABIs in a container in accordance with an embodiment of the present invention, in both suspended (3(*a*)) and post-trauma (3(*b*)) positions.
Figure 3B:
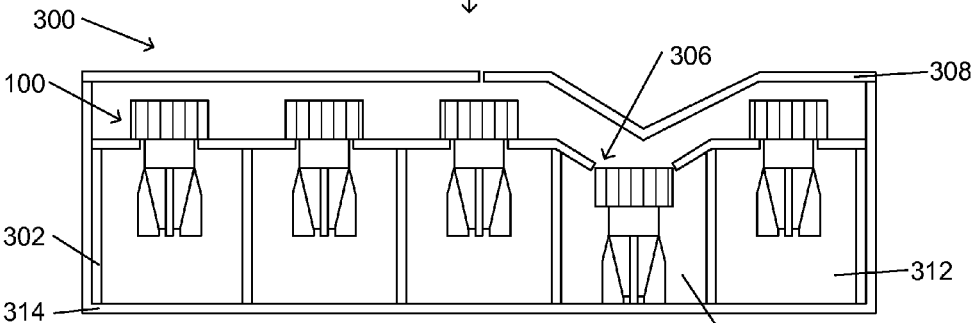

FIGS. 3(*a*) and 3(*b*) are schematic side elevational and sectional views of a container 300 in which a plurality of FABIs 100 are held in accordance with an embodiment of the present invention. In FIG. 3(*a*), the FABIs 100 are suspended by an insert 304 in the position in which the FABIs 100 are normally placed for shipment or storage. In FIG. 3(*b*), the container 300 is shown in an exemplary "post-trauma" position, in which, due to an impact, one FABI 100 has been pushed through the insert 304, as described above with respect to FIG. 2(*b*).

As shown in FIG. 3(*a*), the vial and cap assembly of the FABI 100 is suspended by the insert 304, with the opening 306 having a size greater than the width $w_2$ of the indentation forming the neck of the vial, with the cap 104 resting on the insert 304, and with the opening 306 having a size less than the first width $w_1$, such that the FABI 100 can be suspended at least partially within the receptacle 312 with the lower rim of the cap 104 resting on the insert 304 adjacent the opening 306. The FABI 100 remains suspended in this position during normal shipping, handling and storage. As shown in FIG. 3(*a*), the sidewalls (corresponding to a grid) 302 have a height $h_3$, and the container has a depth $d_1$, and the height $h_3$ is less than the depth $d_1$, so that a space is formed above the sidewalls or grid. As shown in FIG. 3(*a*), with the sidewalls 302 and the insert 304 positioned with the vial and cap assembly, the cover 308 can be closed without contacting the vial and cap assembly. In the embodiment shown in FIGS. 3(*a*) and 3(*b*), the sidewalls 302, the FABI 100, and the insert 304 are inside an outer body 314. The outer body 314 includes a cover 308, outer walls and a bottom panel, and forms a plurality of receptacles 312. The foregoing description relating to the depth $d_1$ of the container and the height $h_3$ of the receptacle is applicable to the other embodiments of the present invention as well.

As shown in FIG. 3(*b*), one FABI 100 which was suspended in FIG. 3(*a*) has been pushed through the frangible insert 304 by an impact or trauma applied to the cover 308. The impact or trauma applied to the cover 308 caused the cover to contact the cap 104 and push downward on the vial and cap assembly (FABI) 100, causing the frangible portion of the insert 304 to give way, break, deform or otherwise open sufficiently to allow the vial and cap assembly 100 to fall through, into the receptacle 312, in accordance with the present invention. As shown schematically in FIG. 3(*b*), the vial and cap assembly 100 which has been pushed through is still protected, has not been activated, and can remain in the receptacle 312. Due to the design of the present invention, even though the outer container was struck by some force sufficient to significantly damage the container and to cause the vial and cap assembly 100 to be pushed through the frangible insert 304, by enlarging the opening 306, the vial and cap assembly were not impacted so as to avoid accidental or unintended premature activation of the vial and cap assembly.

Figures 4A, 4B, 4C, 4D:
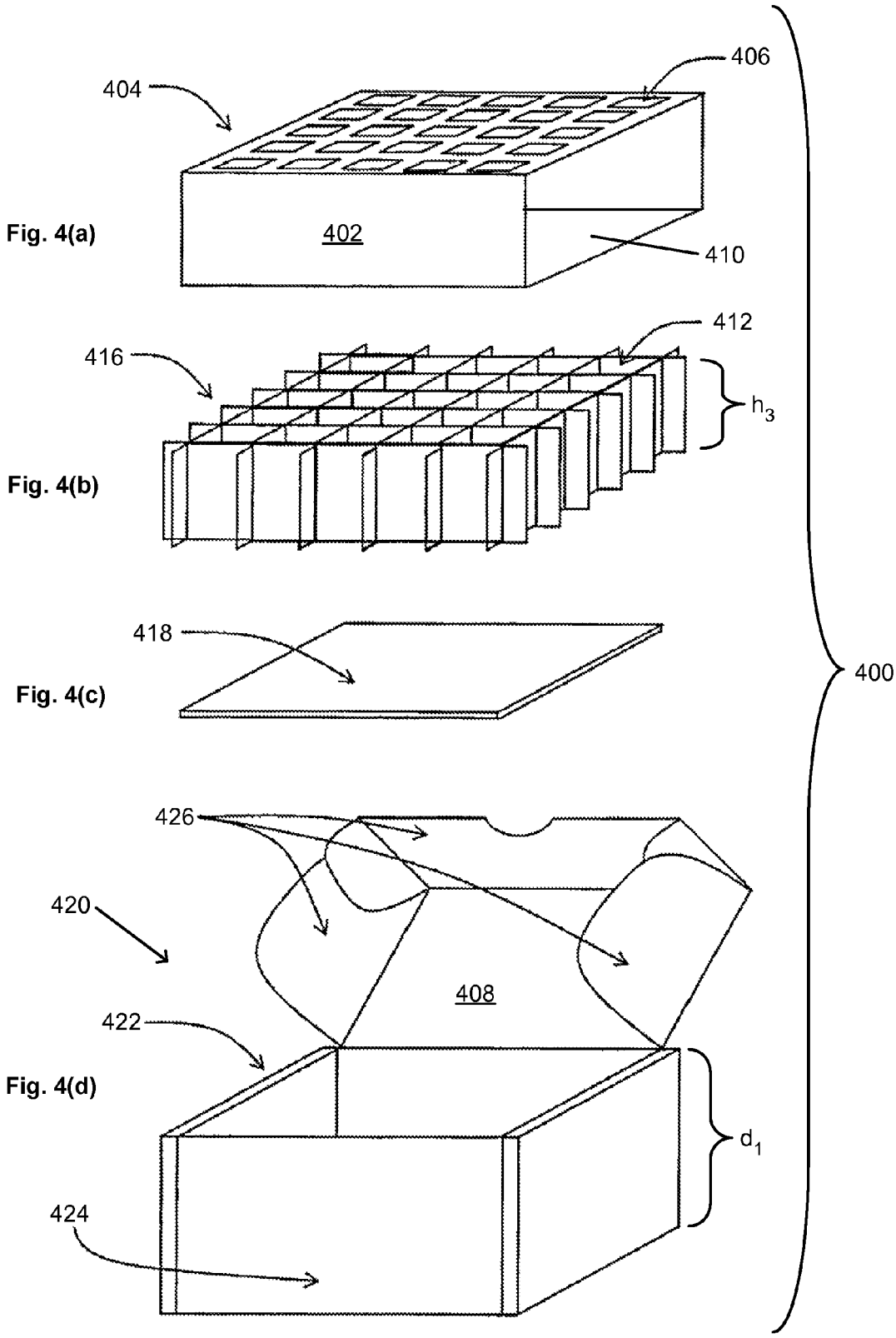
FIGS. 4(*a*), 4(*b*), 4(*c*) and 4(*d*) are perspective views of components of an embodiment of the present invention.

FIGS. 4(*a*), 4(*b*), 4(*c*) and 4(*d*) are perspective views of components of an embodiment of an impact and crush resistant shipping container 400 of the present invention. FIG. 4(*a*) illustrates an embodiment of the insert 404, in which the insert is in the form of a sleeve. As illustrated, the sleeve insert 404 has side panels 402 and a bottom panel 410, and at least one end that is open (of course, both ends may be open) and sized to receive the partitioning divider. The sleeve insert 404 includes a plurality of openings 406, which correspond to the openings 206 and 306 described above. The sleeve 404 shown in FIG. 4(*a*) includes a 5×5 array of openings 406. As will be understood, this is an arbitrary choice, and other grid arrangements can be used.

FIG. 4(*b*) illustrates a grid 416, which forms a plurality of receptacles 412. The grid 416 corresponds or is similar to the sidewalls 302 shown in FIGS. 3(*a*) and 3(*b*). The grid 416 is also referred to herein as a partitioning divider, and provides vertical protection against impact, trauma, crushing force, etc. The receptacles 412 should be the same in number and arrangement as the openings 406 in the sleeve 404, thus keeping each FABI 100 properly aligned in its receptacle 412.

FIG. 4(*c*) schematically illustrates an optional absorbent pad 418, which can be used with any embodiment of the present invention. In one embodiment, the absorbent pad has a top layer perforated with one-way valves, which allow ingress of liquid but prevent egress or escape of the liquid, a middle layer containing a high-capacity absorbent, and bottom layer formed of a fluid-impermeable layer. Such absorbent pads are known in the art, can be suitably selected by the skilled person and will not be further described herein. The absorbent pad may include an antimicrobial material designed to prevent growth of any microorganisms that might possibly escape from a damaged FABI in the event of a total failure and loss of microorganisms from the FABI.

FIG. 4(*d*) schematically illustrates an outer body 420, having outer side walls 422, 424, a bottom (not visible in FIG. 4(*d*), but corresponding to the bottom panel 210 in FIGS. 2(*a*) and 2(*b*)), a cover 408 and, attached to the cover 408, side flaps 426. The side flaps 426 can be inserted inside the outer side walls 422, 424 to provide both secure closure of the container 420 and additional padding for enhanced protection of the contents of the container 420. The outer side walls 422, 426, the bottom, and the cover 408 may be made of double-walled material in various embodiments and combinations.

As shown in FIG. 4(*b*), the grid 416 has a height $h_3$, and, as shown in FIG. 4(*d*), the container 420 has a depth $d_1$. The height $h_3$ is less than the depth $d_1$, so that a space is formed above the grid inside the container.

In use, the grid 416 can be slid into the end opening of the sleeve insert 404, to form a partial construct of a container in accordance with the present invention. This partial construct can be inserted into the container 420, to form a complete impact and crush resistant shipping container 400, in accordance with an embodiment of the present invention. The optional absorbent pad 418 may be inserted into the bottom of the container 420 prior to insertion of the partial construct. The FABI cap and vial assemblies would be inserted into the insert after the grid 416 is slid into the end opening of the sleeve insert 404.

Figure 5A:
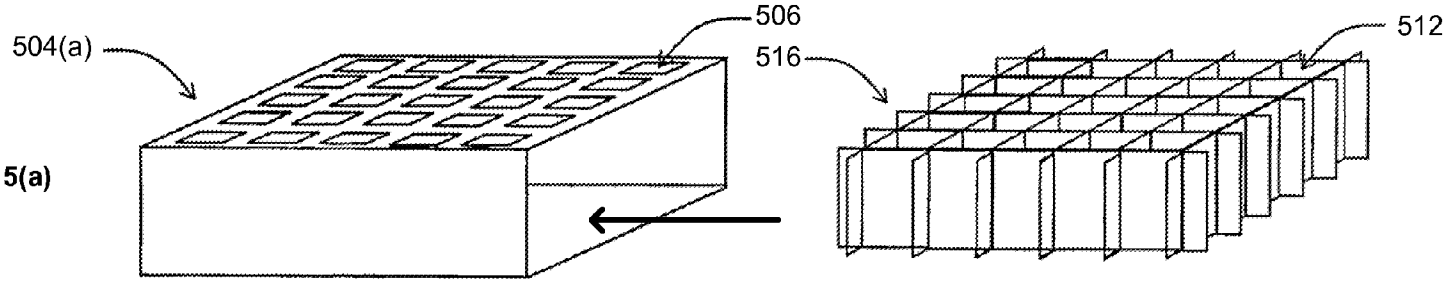
FIGS. 5(*a*), 5(*b*) and 5(*c*) are perspective views of three different embodiments of an insert and partitioning divider of the present invention.
Figure 5B:
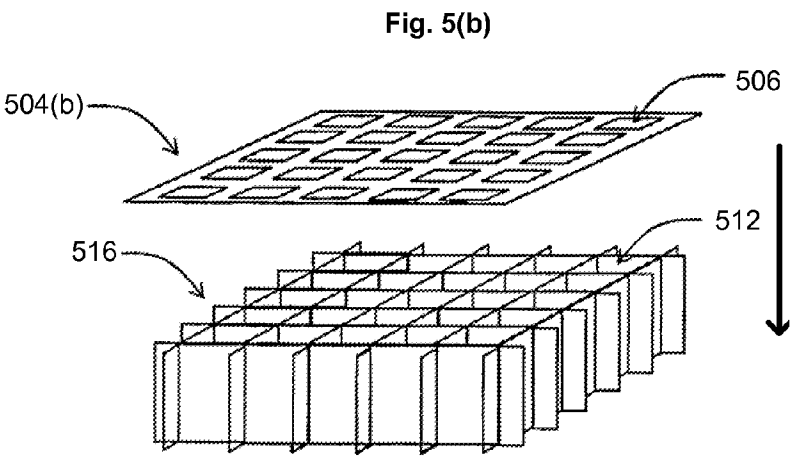
Figure 5C:
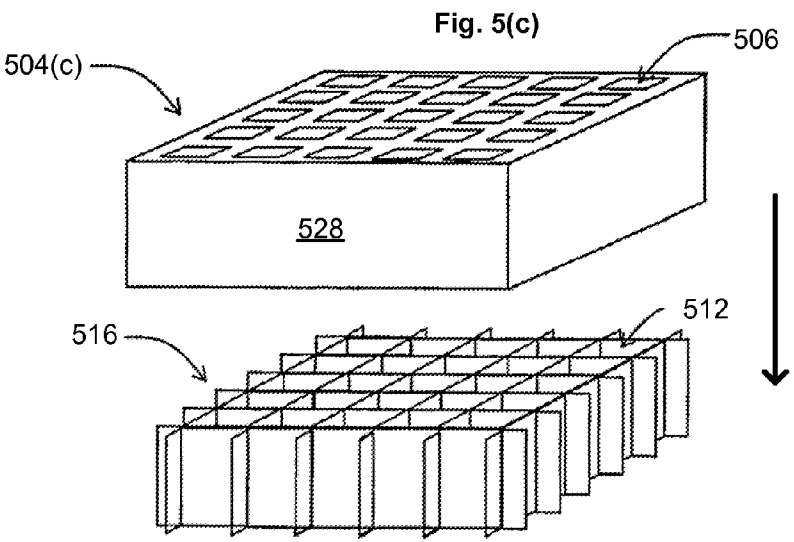

FIGS. 5(*a*), 5(*b*) and 5(*c*) are perspective views of three different embodiments of the present invention, illustrating how various inserts can be used with a grid.

FIG. 5(*a*) illustrates a sleeve insert 504(*a*), which corresponds to the sleeve 404 shown in FIG. 4(*a*), which includes an exemplary 5×5 grid of openings 506. A grid 516 includes receptacles 512. The grid 516 can be inserted into the open end of the sleeve insert 504(*a*), similar to the description above for FIG. 4.

FIG. 5(*b*) illustrates a flat panel embodiment of an insert 504(*b*), which includes an exemplary 5×5 grid of openings 506, similar to that shown and described for FIGS. 4 and 5(*a*). A grid 516 includes receptacles 512. In this embodiment, the flat panel insert 504(*b*) is placed on the grid 516. In this embodiment, the FABI vial and cap assemblies can be inserted into the openings 506 prior to placement of the insert 504(*b*) onto the grid 516.

FIG. 5(*c*) illustrates an open-bottom insert 504(*c*), which includes an exemplary 5×5 grid of openings 506, and has side walls 528 on all four sides. A grid 506 includes receptacles 512. In this embodiment, the open-bottom insert 504(*c*) is lowered onto the grid 516, and the side walls 528 provide both additional protection and a means for aligning the 5×5 grid of openings 506 with the corresponding receptacles 512. In this embodiment, the FABI vial and cap assemblies can be inserted into the openings 506 prior to placement of the insert 504(*c*) onto the grid 516.

In various embodiments described above and shown in the drawings, the present invention may be described as follows, with reference to various of the drawings. In one embodiment, the present invention provide an impact and crush resistant shipping container, e.g., as shown in FIGS. 4(*a*)-(*d*) as reference numeral 400, for use with at least one vial and cap assembly, e.g., FABI 100, the at least one vial and cap assembly 100 having an assembly height $h_1$, a first width $w_1$ and an indentation having a second width $w_2$ less than the first width, the indentation located intermediate the assembly height, as shown in FIG. 1(*a*), the container including:

an outer body 420 having sides 422, 424 and a bottom defining a cavity and an opening, the cavity having a depth $d_1$, the body further including a closeable cover 408 for enclosing the cavity;

a partitioning divider (or grid) 416, 516 defining at least one vertically extending receptacle 412 for receiving at least a portion of the at least one vial and cap assembly, the receptacle 412 having a depth greater than the assembly height, the partitioning divider having a height $h_3$ less than the depth $d_1$ of the cavity, as shown in FIGS. 3*a* and 4;

an insert 204, 304, 404, 504(*a*), 504(*b*), 504(*c*) having at least one opening 206, 306, 406, 506 therethrough for receiving the at least one vial and cap assembly 100, each opening having a width or size greater than the second width $w_2$ and less than the first width $w_1$ of the at least one vial and cap assembly such that the at least one vial and cap assembly 100 can be suspended in the opening 206, 306, 406, 506 of the insert 204, 304, 404, 504(*a*), 504(*b*), 504(*c*) at the indentation, in which the partitioning divider 416, 516 is positionable with respect to the insert 204, 304, 404, 504(*a*), 504(*b*), 504(*c*) such that the at least one vial and cap assembly 100 can be suspended at least partially within the receptacle 312, 412, 512, in which the partitioning divider 416, 516 and the insert 204, 304, 404, 504(*a*), 504(*b*), 504(*c*) with the at least one vial and cap assembly 100 suspended therein are positionable within the cavity such that, with the partitioning divider and the insert with the at least one vial and cap assembly positioned within the cavity, the cover 408 can be closed without contacting the at least one vial and cap assembly 100. In the foregoing general description, it is noted that reference to specific drawings and/or elements thereof is for purposes of illustration only, and is not intended to be limiting in any way. It is noted that omission of any drawing or reference number from the foregoing description is for brevity, and is not intended to be limiting in any way.

Figure 6A:
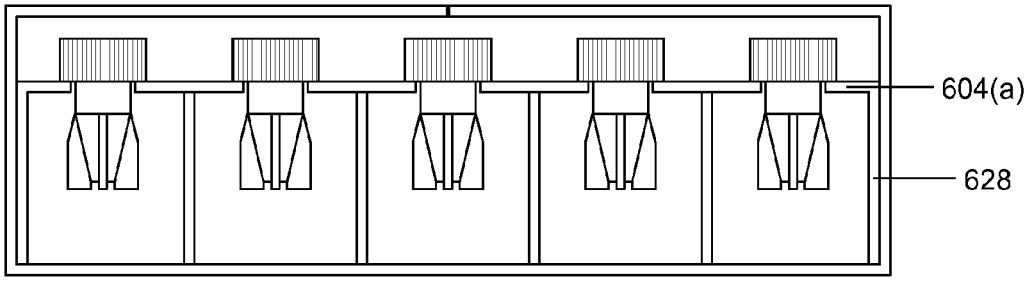
FIGS. 6(*a*), 6(*b*) and 6(*c* are schematic side elevational and sectional views that schematically illustrate several embodiments of the present invention, with vial and cap assemblies (FABIs) in place.
Figure 6B:
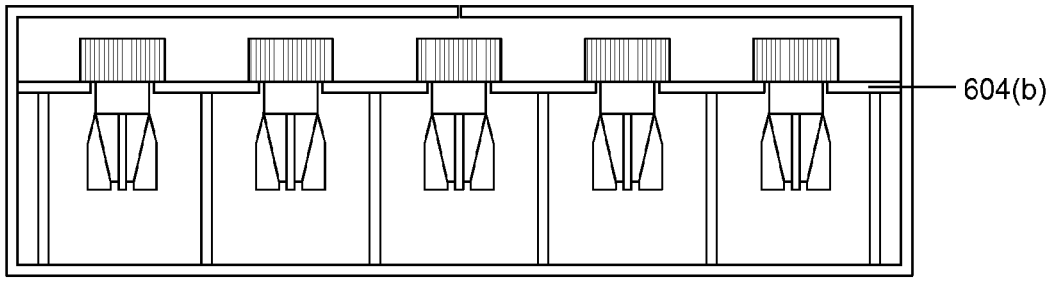
Figure 6C:
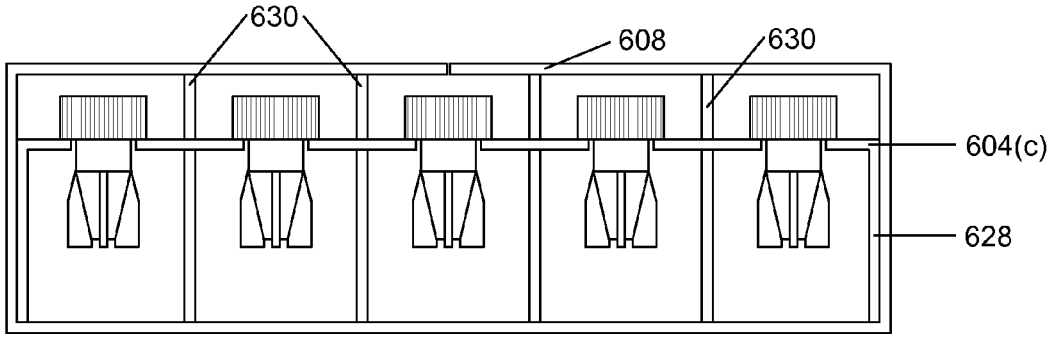
Figure 7A:
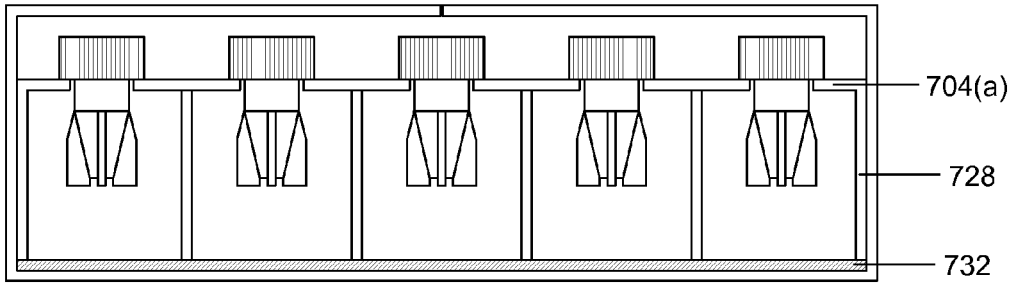
FIGS. 7(*a*), 7(*b*), 7(*c*) and 7(*d*) are schematic side elevational and sectional views that schematically illustrate several embodiments of the present invention including an absorbent pad under the grid, with vial and cap assemblies (FABIs) in place.
Figure 7B:
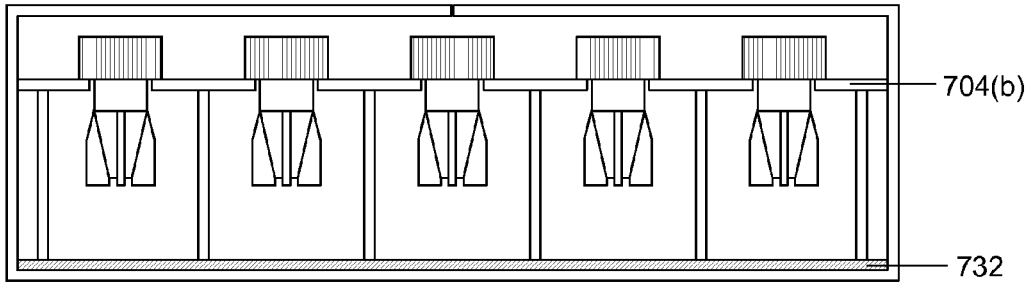
Figure 7C:
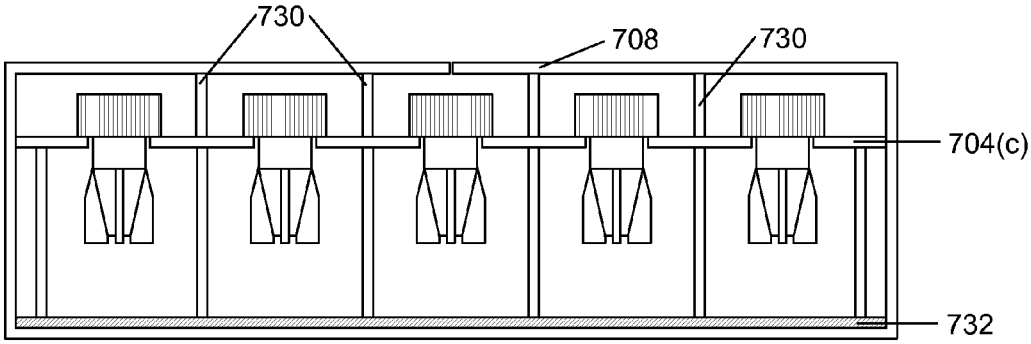
Figure 7D:
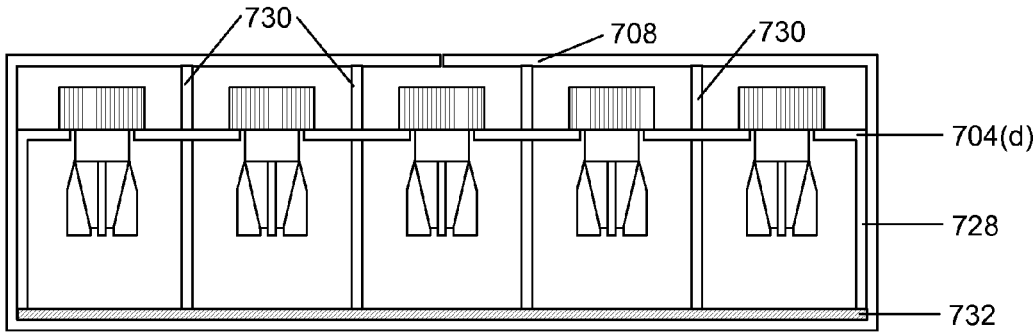

FIGS. 6(*a*), 6(*b*) and 6(*c*) are schematic side elevational and sectional views that schematically illustrate several embodiments of the present invention. Any elements not specifically mentioned in the following are substantially the same as described with respect to embodiments illustrated in one or more of FIGS. 1(*a*), 1(*b*), 2(*a*), 2(*b*), 3(*a*) and 3(*b*).

FIG. 6(*a*) illustrates an embodiment in which the insert 604(*a*) has vertical side walls 628, similar to that shown in FIG. 5(*c*).

FIG. 6(*b*) illustrates an embodiment in which the insert 604(*b*) is a flat panel, similar to that shown in FIG. 5(*b*).

FIG. 6(*c*) illustrates an embodiment in which the insert 604(*c*) has vertical side walls 628, similar to that shown in FIG. 5(*c*), and the container further includes a reinforcing divider 630 in the space between the insert 604(*c*) and a cover 608. In one embodiment, as shown in FIG. 6(*c*), elements of the reinforcing divider are substantially aligned with and correspond to elements of the partitioning divider. Thus, in such embodiment including a reinforcing divider, forces applied to the cover of the container are borne by the reinforcing divider and are transmitted to the partitioning divider, thus strengthening the entire container.

FIGS. 7(*a*), 7(*b*), 7(*c*) and 7(*d*) are schematic side elevational and sectional views that schematically illustrate several embodiments of the present invention including an absorbent pad under the grid.

FIG. 7(*a*) illustrates an embodiment in which the insert 704(*a*) has vertical side walls 728, similar to that shown in FIGS. 5(*c*) and 6(*a*), and further includes an absorbent pad 732.

FIG. 7(*b*) illustrates an embodiment in which the insert 704(*b*) is a flat panel, similar to that shown in FIGS. 5(*b*) and 6(*b*), and further includes an absorbent pad 732.

FIG. 7(*c*) illustrates an embodiment in which the insert 704(*c*) is a flat panel, similar to that shown in FIGS. 5(*b*) and 6(*b*), the container further includes an absorbent pad 732, and the container further includes a reinforcing grid 730 in the space between the insert 704(*c*) and a cover 708.

FIG. 7(*d*) illustrates an embodiment in which the insert 704(*d*) has vertical side walls 728, similar to that shown in FIGS. 5(*c*) and 6(*a*), the container further includes an absorbent pad 732, and the container further includes a reinforcing grid 730 in the space between the insert 704(*c*) and a cover 708. In one embodiment, as shown in FIGS. 7(*c*) and 7(*d*), elements of the reinforcing divider are substantially aligned with and correspond to elements of the partitioning divider, providing the benefits mentioned above with respect to FIG. 6(*c*).

Figure 8A:
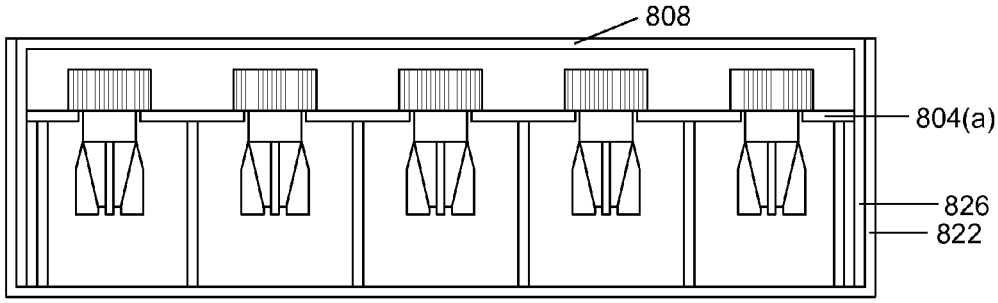
FIGS. 8(*a*), 8(*b*) and 8(*c*) are schematic side elevational and sectional views that schematically illustrate several embodiments of the present invention in which the container comprises flap sides on the cover, with vial and cap assemblies (FABIs) in place.
Figure 8B:
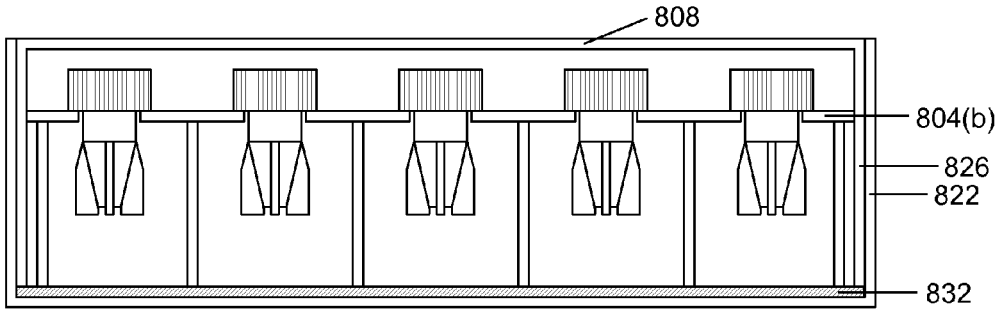
Figure 8C:
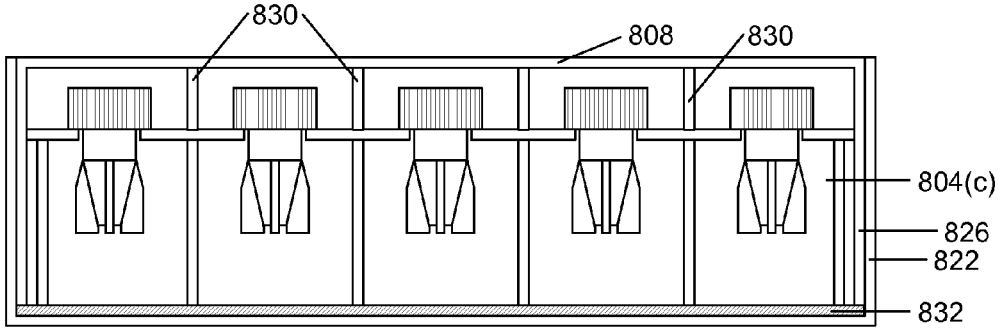

FIGS. 8(*a*), 8(*b*) and 8(*c*) are schematic side elevational and sectional views that schematically illustrate several embodiments of the present invention in which the container comprises flap sides on the cover.

FIG. 8(*a*) illustrates an embodiment in which the insert 804(*a*) is a flat panel, the cover 808 includes flap sides 826 which are insertable within the outer wall 822, similar to the embodiment shown in FIG. 4(*d*).

FIG. 8(*b*) illustrates an embodiment in which the insert 804(*b*) is a flat panel, the cover 808 includes flap sides 826 which are insertable within the outer wall 822, similar to the embodiment shown in FIG. 4(*d*), and the container further includes an absorbent pad 832.

FIG. 8(*c*) illustrates an embodiment in which the insert 804(*c*) is a flat panel, the cover 808 includes flap sides 826 which are insertable within the outer wall 822, similar to the embodiment shown in FIG. 4(*d*), and the container further includes an absorbent pad 832 and a reinforcing grid in the space between the insert 804(*c*) and a cover 808. In one embodiment, as shown in FIG. 8(*c*), elements of the reinforcing divider are aligned with and correspond to elements of the partitioning divider, providing the benefits mentioned above with respect to FIGS. 6(*c*) and 7(*d*).

In one embodiment, the outer body, the partitioning divider, the reinforcing divider and/or the insert includes or is made of reinforced cardboard or plastic, double layer cardboard or plastic, corrugated cardboard or plastic, or a combination of any two or more thereof. Other known materials may be suitably substituted as will be understood by those of skill in the art.

As shown by the foregoing description, a grid or partitioning divider (e.g., FIG. 4(*b*)) is employed within an outer body (e.g., FIG. 4(*d*)) so as to provide an individual cell for each vial and cap assembly or FABI 100. A new element is added in the form of an insert (e.g., FIG. 4(*a*)) with openings 406 slightly smaller than the diameter of the FABI cap 104. The openings are aligned such that each is centered above a cell or receptacle of the underlying grid. The outer body is dimensioned such that, when filled with FABI indicators and the cover closed, there will be a small amount of headspace above the tops of the caps 104. By this non-traditional arrangement, the suspended vial and cap assemblies are first protected by the structure of the outer body, are positioned above the protective receptacles should they encounter any traumatic compression events and are readily accessible for easy removal without activation once the outer body is opened.

The benefits of the present invention derive from the design and function of the insert 204, 304, 404, etc. Because the openings 206, 306, 406, etc. in the insert are smaller than the diameter of the cap 104 of the FABI 100, the cap 104 and the attached vial 102 can be suspended above a receptacle 212, 312, 412, etc. deep enough to accept the whole height of the assembled indicator without activation of the FABI or other vial and cap assembly (FIGS. 2(*a*) and 3(*a*) with the whole weight of the assembly resting upon the insert at the lower rim of the cap 104. In this way the vial and cap assembly is prevented from interactions (e.g., the cap moving down upon the vial, or the vial moving up into the cap) that can result in unintentional, premature activation of the FABI or other vial and cap assembly. Such unintentional, premature activation can happen when these same parts (cap and vial assembly) are packaged by traditional means and subsequently subjected to vibrations or impact in transport, dropped or possibly damaged when the end user reaches into the cell to pull the FABI out. Crush testing conducted on the FABI assembly itself reveals that it only takes from 17 to 18 pounds force to induce a rupture of the seal of the cap when that force is applied top to bottom or bottom to top. Conversely, it requires in excess of 400 pounds force to induce the same failure when the forces are applied laterally.

Furthermore, in more pronounced traumas (e.g. crushing events) beyond the normal range that a standard box can be expected to adequately absorb and still protect its contents, the suspension of the FABI 100 in accordance with the present invention provides a second and third level of protection. Once the box is impacted, any remaining trauma force is applied to the caps separately from the remainder of the FABI (e.g., top down trauma) or to the grid (e.g., bottom up trauma). The grid and the cap are the strongest structures of the shipping container of the present invention. In cases where the trauma encountered exceeds the resistance of the box and the insert and impacts on the suspended cap, the lip of the cap will be driven through the insert (as in FIGS. 2(*b*) and 3(*b*)), whereupon the whole cap and vial assembly will be pushed through the opening in the insert and delivered to the receptacle beneath the insert without activation of the FABI. At this point, and depending upon the specified resistance built into the design of the grid, it will take exceptional levels of applied force (e.g., greater than 5,000 pounds force over the area of the package) before unintentional activation can take place.

Although providing hardened packaging for frangible contents is not a new concept, providing a simple, low-cost insert that presents the contents in an easily extractable form and that is also designed to be fail safe under particular circumstances is new and particularly advantageous. The cap 104 of the present indicator has a width that is greater than the vial 102 (see FIG. 1(*a*)). This, plus the fact that the cap contains the liquid medium, makes it more massive than the underlying vial. As a result, the cap is prone to closing upon the vial and prematurely activating the FABI. The FABI was designed to be activated without the need for a tool and preferably requiring only one hand to activate. This feature would otherwise lead to its susceptibility to vibratory and drop traumas. By isolating the weight of the cap component within the head space between the top surface of the insert and the underside of the closed container cover, the cap cannot easily be driven onto the vial, thus prematurely activating the FABI.

While it is possible for one to simply ship and store the indicator already inside the cells of a conventional partitioning divider (a common practice) this does not isolate the cap to prevent closing on vibration or dropping. This also does not protect the FABI if the container would be inverted and the weight of the FABI transferred in a top-down manner on the cap. Furthermore, in attempting to retrieve the indicator from the cells of the conventional partition it is possible to inadvertently activate the product.

In a compression event, first the outer container would be crushed to the extent that the force trauma would be transferred to the cap and to the contact between the cap and sleeve, but not to the vial. At a force trauma less than that necessary to crush the cap, the portion of the insert supporting the cap above the cell will collapse and the cap and vial assembly will drop into the receptacle and remain un-activated. At this point, any further crush force will be absorbed by the grid to an extent relative to the material of construction of the grid. This exceeds even the most extreme crush force trauma expected in the normal shipping and handling of the intended product. It should also exceed the expectations of regulatory bodies who may be concerned if the contained product is biological in nature.

While the principles of the invention have been explained in relation to certain particular embodiments, these embodiments are provided for purposes of illustration. It is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the claims.

The invention claimed is:

1. An impact and crush resistant shipping container comprising:

at least one vial and cap assembly, the at least one vial and cap assembly having an assembly height, a first width and an indentation having a second width less than the first width, the indentation located intermediate the assembly height, the vial and cap assembly comprising an un-activated position and an activated position and the vial and cap assembly being activatable by an action comprising a reduction of the assembly height;

an outer body having sides and a bottom defining a cavity and an opening, the cavity having a depth, the body further comprising a closeable cover for enclosing the cavity;

a partitioning divider defining at least one vertically extending receptacle for receiving at least a portion of the at least one vial and cap assembly, the receptacle having a depth greater than the assembly height, the partitioning divider having a height less than the depth of the cavity;

an insert having at least one opening therethrough for receiving the at least one vial and cap assembly, each opening having a width greater than the second width and less than the first width of the at least one vial and cap assembly such that the at least one vial and cap assembly is suspended in the opening of the insert at the indentation, wherein the partitioning divider is positioned in relation to the insert such that the at least one vial and cap assembly is suspended at least partially within the receptacle, wherein the partitioning divider and the insert with the at least one vial and cap assembly suspended therein are positioned within the cavity such that the cover can be closed without contacting the at least one vial and cap assembly, wherein the opening in the insert further comprises a frangible or deformable portion, wherein if a sufficient force is applied to the vial and cap assembly, the vial and cap assembly can be pushed through the opening and pass into the receptacle by breaking or deforming the frangible or deformable portion and the receptacle depth is sufficient to avoid contact between the broken or deformed portion sufficient to activate the vial and cap assembly when the vial and cap assembly has passed into the receptacle.

2. The container of claim 1 wherein the insert comprises a substantially flat panel with the openings therethrough.

3. The container of claim 2 wherein the insert further comprises a plurality of vertically extending outer sidewalls dimensioned to fit outside an outer periphery of the partitioning divider within the cavity.

4. The container of claim 2 wherein the insert further comprises a pair of vertically extending sidewalls attached on opposite sides of the insert and a lower panel attached to the sidewalls, such that the insert forms a sleeve dimensioned to receive the partitioning divider within the sleeve.

5. The container of claim 1 further comprising an absorbent pad within the outer body.

6. The container of claim 5 wherein the absorbent pad is disposed in the cavity and the partitioning divider is positioned over the pad.

7. The container of claim 5 wherein the absorbent pad is disposed in a bottom portion of the cavity.

8. The container of claim 7 wherein the absorbent pad further comprises an antimicrobial material.

9. The container of claim 1 further comprising a reinforcing divider disposed within the cavity on an opposite side of the insert from the partitioning divider and extending toward the cover.

10. The container of claim 9 wherein elements of the reinforcing divider are substantially aligned with and correspond to elements of the partitioning divider.

11. The container of claim 1 wherein the cover further comprises side and front flaps insertable into the cavity when the cover closes.

12. The container of claim 1 wherein placement of the vial and cap assembly in the insert and partially into the cavity prevents premature and/or accidental activation of the vial and cap assembly during shipment and handling of the container.

13. The container of claim 1 wherein the vial and cap assembly contains a sterilization indicator.

14. The container of claim 13 wherein the sterilization indicator comprises a self-contained biological indicator.

15. The container of claim 13 wherein the sterilization indicator comprises a fast-acting biological indicator.

16. The container of claim 1 wherein the outer body comprises one or a combination of any two or more of reinforced cardboard or plastic, double layer cardboard or plastic, corrugated cardboard or plastic.

17. The container of claim 1 wherein the partitioning divider comprises one or a combination of any two or more of reinforced cardboard or plastic, double layer cardboard or plastic, corrugated cardboard or plastic.

* * * * *